US008899072B2

(12) United States Patent
Veettil et al.

(10) Patent No.: US 8,899,072 B2
(45) Date of Patent: Dec. 2, 2014

(54) ICE MAKER MOUNTING ADAPTER FOR ICE AND BEVERAGE DISPENSER

(75) Inventors: Shaji Kulangara Veettil, Kannur (IN); Nishant Kulkarni, Karnataka (IN); Douglas Anderson, St. Charles, IL (US)

(73) Assignee: Cornelius, Inc., St. Paul, MN (US)

( * ) Notice: Subject to any disclaimer, the term of this patent is extended or adjusted under 35 U.S.C. 154(b) by 1344 days.

(21) Appl. No.: 12/387,602

(22) Filed: May 5, 2009

(65) Prior Publication Data

US 2009/0278024 A1 Nov. 12, 2009

Related U.S. Application Data

(60) Provisional application No. 61/126,834, filed on May 7, 2008.

(51) Int. Cl.
*F25D 3/02* (2006.01)
*F25C 5/18* (2006.01)

(52) U.S. Cl.
CPC ..... *F25C 5/182* (2013.01); *B67D 2210/00034* (2013.01)
USPC ..... 62/464; 62/398; 62/459; 62/529; 62/530; 62/390; 62/344; 312/236; 222/129.1

(58) Field of Classification Search
USPC ..... 312/236, 198; 108/143; 222/146.6, 222/129.1; 62/389, 398, 459, 464, 529, 62/530, 390, 344, 465, 466
See application file for complete search history.

(56) References Cited

U.S. PATENT DOCUMENTS

| | | | | | |
|---|---|---|---|---|---|
| 4,260,069 | A * | 4/1981 | Juergens | 220/812 |
| 4,555,045 | A * | 11/1985 | Rodth et al. | 222/1 |
| 4,736,689 | A * | 4/1988 | Stanko | 108/5 |
| 4,898,294 | A * | 2/1990 | Jennings | 220/592.09 |
| 4,960,228 | A * | 10/1990 | Takahashi et al. | 222/129.1 |
| 5,887,758 | A * | 3/1999 | Hawkes et al. | 222/146.6 |
| 6,880,358 | B2 * | 4/2005 | Lucas et al. | 62/344 |
| 7,168,261 | B2 * | 1/2007 | Grewal et al. | 62/340 |
| 8,038,235 | B2 * | 10/2011 | Lowery et al. | 312/401 |
| 8,607,588 | B2 * | 12/2013 | Oh | 62/465 |
| 2004/0263036 | A1 * | 12/2004 | Zizas | 312/404 |
| 2006/0049731 | A1 * | 3/2006 | Choi et al. | 312/330.1 |

* cited by examiner

*Primary Examiner* — Terrell McKinnon
*Assistant Examiner* — Michael McDuffie
(74) *Attorney, Agent, or Firm* — Andrus Intellectual Property Law, LLP

(57) ABSTRACT

An adapter for mounting an icemaker on top of an ice bin of an ice and beverage dispenser has a lid mounted for both sliding movement and pivotal movement relative to the remainder of the adapter. The lid normally covers an inlet to the ice bin. To expose the ice bin inlet for visually inspection of the interior of the bin and/or to accommodate manual filling of the bin with ice, the lid is manually slid forward off of and then be rotated away from the bin inlet to fully expose the inlet. The lid at all times remains connected to the adapter so that it is not lost or exposed to unsanitary conditions.

15 Claims, 9 Drawing Sheets

ICE MAKER MOUNTING ADAPTER FOR ICE AND BEVERAGE DISPENSER

This application claims benefit of provisional patent application Ser. No. 61/126,834, filed May 7, 2008.

BACKGROUND OF THE INVENTION

The present invention relates to assemblies for mounting ice making machines on top of ice and beverage dispensing machines.

As is known, ice/beverage dispensing machines include ice retaining hoppers or bins having top ice loading openings. A bin cover normally closes the bin opening and is removable to permit visual inspection of the bin and/or filling of the bin with ice. Filling may be manually accomplished by lifting and emptying buckets of ice into the bin until it is sufficiently full. To decrease the difficulties associated with manually filling bins and to minimize the occasions when the bins may be emptied of ice, it is known to mount an ice making machine or icemaker on top of the ice/beverage machine, so that ice made by the icemaker drops directly into the bin. However, the particular icemaker selected can be from one of several different manufacturers and, therefore, can have a footprint or dimensions that may or may not accommodate direct mounting of the icemaker on top of a given ice/beverage dispensing machine.

Accordingly, icemaker mounting adapters are often required for mounting ice making machines on top of ice and beverage dispensing machines. Advantageously, such an adapters should accommodate convenient visual inspection of and/or manual filling of an ice bin of the ice and beverage dispenser on which it supports an icemaker, while maintaining a sanitary seal between the bin and ambient and, at the same time, enabling convenient access to the ice making machine should repair or maintenance of the icemaker be required.

OBJECTS OF THE INVENTION

An object of the present invention is to provide a mounting adapter for supporting an ice making machine on a beverage dispensing machines.

Another object is to provide such a mounting adapter that accommodates convenient visual inspection and/or manual filling of an ice bin of the ice and beverage dispenser.

A further object is to provide such a mounting adapter that maintains a sanitary seal between the bin and ambient.

Yet another object is too provide such a mounting adapter that enables convenient access to the ice making machine, without need to remove the machine from the adapter, should repair or maintenance of the icemaker be required.

SUMMARY OF THE INVENTION

In accordance with the present invention, an adapter for mounting an icemaker on top of an ice and beverage dispenser comprises a frame having an opening therethrough, a bottom side for being supported on a rearward portion of a top perimeter edge of a top opening to an ice retaining bin of the dispenser, and a top side for supporting the icemaker above the ice retaining bin for passage of ice from the icemaker through the frame opening and into the bin. A front of the frame is spaced rearward from a front of the top perimeter edge of the bin to define an inlet to the bin between the front of the frame and the front of the top perimeter edge, and the adapter also has a lid; at least two slider assemblies; means for slidably attaching the at least two slider assemblies to the frame for movement in forward and rearward directions relative to the frame; and at least two hinges for hinging the lid to forward ends of the slider assemblies for pivotal movement of the lid about an axis extending generally perpendicular to the directions of movement of the slider assemblies. The lid, with the adapter supporting the icemaker on the bin, normally extends across and closes the inlet to the bin and is moveable forward on the slider assemblies to uncover the inlet to the bin and then rotatable on the hinges to a location away from the inlet to the bin.

In a preferred embodiment of the adapter, the frame is generally rectangular and has parallel and opposite sides and a back that are U-channel shaped and a front that extends between forward ends of the sides, and the rearward portion of the top perimeter edge of the bin extends into open ends of the frame sides and back to support the frame on the bin. Also, the at least two slider assemblies are two slider assemblies and each is slidably carried by an associated one of the frame sides for forward and rearward movement relative to the frame sides.

For improved sanitation, gasket means is on top and bottom sides of the frame for sealing the frame to each of the icemaker and dispenser bin, and the lid includes channel means for receiving and directing water from the icemaker away from an interior of the bin.

Advantageously, when the adapter is supporting the icemaker on the ice and beverage dispenser and the lid is in its position closing the inlet to the dispenser bin, the adapter has a substantially planar upper side that accommodates opening of a door on a front of the icemaker while the icemaker remains supported on the adapter.

DETAILED DESCRIPTION

Figure 1:
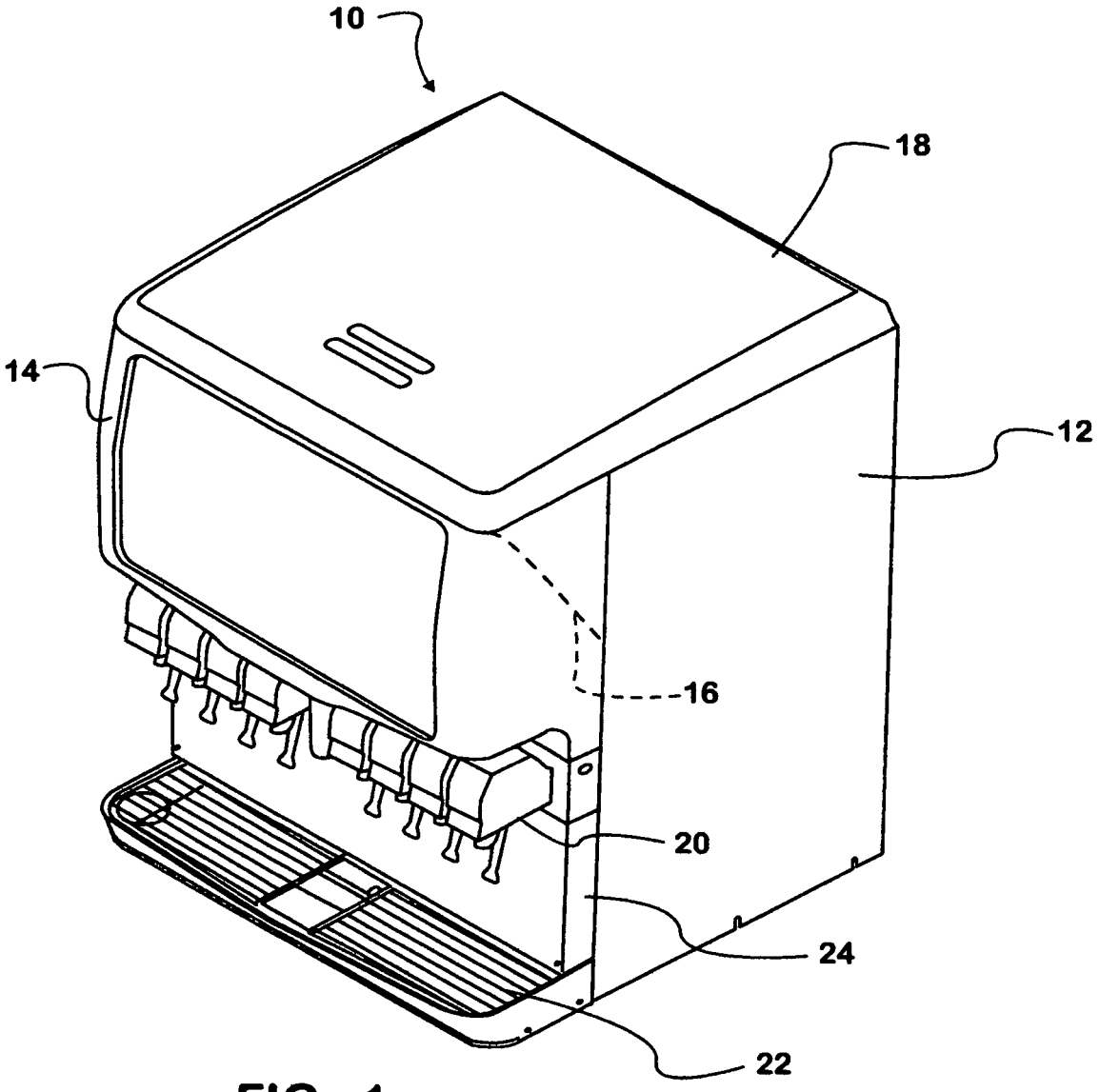
FIG. 1 is a perspective view of a conventional ice and beverage dispensing machine.
Figure 2:
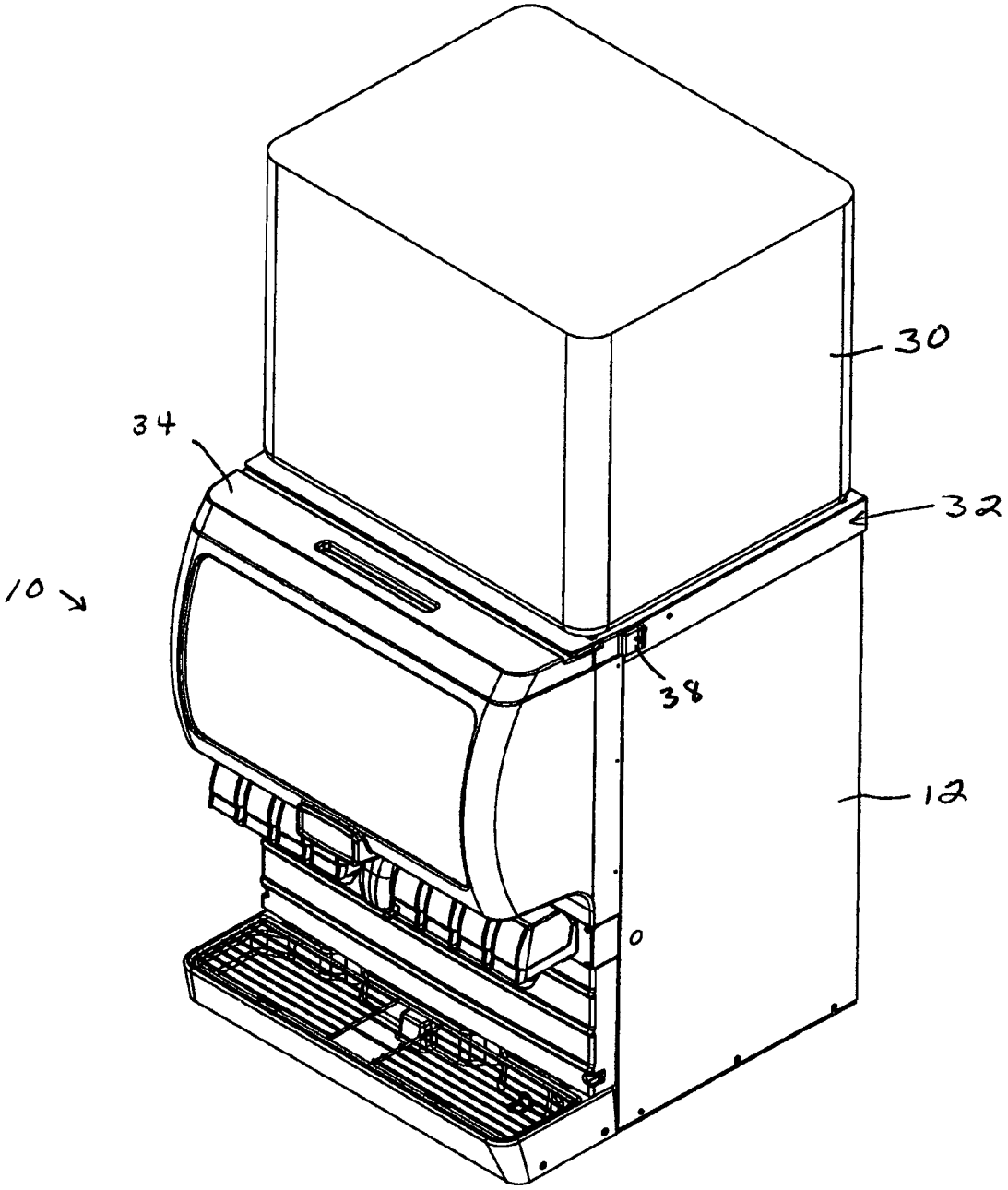
FIG. 2 is a perspective view of an ice making machine mounted on top of an ice and beverage dispensing machine by an adapter constructed according to the teachings of the present invention, showing a lid of the adapter in a rearward position over and closing a forward adapter inlet opening that leads to an ice bin of the ice and beverage dispensing machine.
Figure 3:
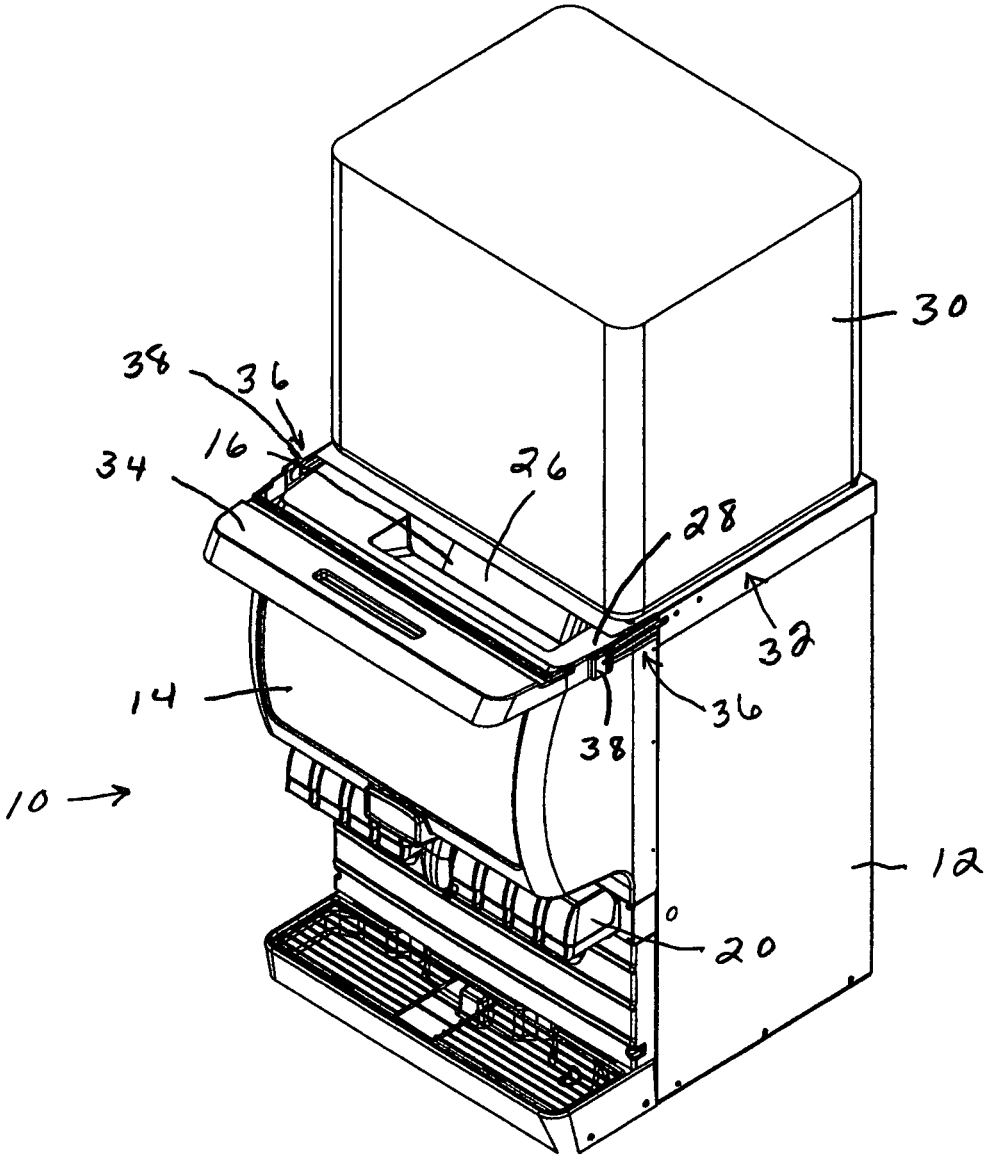
FIG. 3 is similar to FIG. 2, except that the adapter lid is slid to a forward position exposing the adapter inlet opening.
Figure 4:
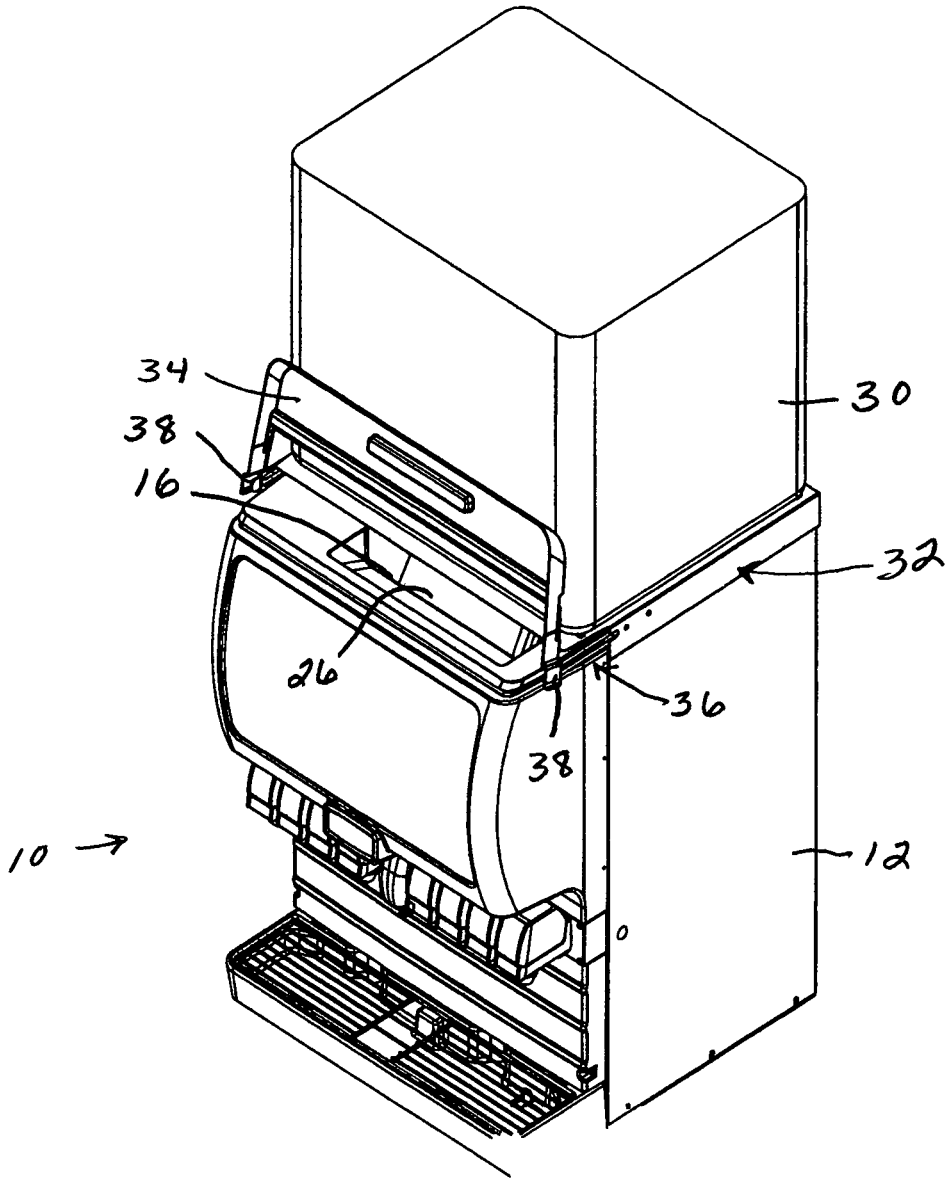
FIG. 4 is similar to FIGS. 2 and 3, except that the adapter lid is both slid forward and rotated upward to fully expose the adapter inlet opening for visual inspection and/or manual filling of the bin.

An ice and beverage dispenser is seen in FIG. 1 and indicated generally at 10. As is conventional, the dispenser includes an outer housing 12, a merchandising cover 14, an ice retaining hopper or bin 16, and a removable ice bin cover 18. The dispenser also has a plurality of beverage dispensing valves 20, a drip tray 22 and a splash panel 24. With reference to FIGS. 2-4, the ice bin 16 is located within the outer housing 12 and has an inlet 26 at a front of an open upper end of the bin defined within an upper perimeter edge 28 of the bin. An ice making machine 30 is mounted on and above the ice and beverage dispenser 10 by a novel ice making machine mounting adapter indicated generally at 32. A bottom surface of the adapter rests on the ice bin upper perimeter edge 28 and a top surface of the adapter supports the icemaker 30. Ice made by the icemaker falls downward into the bin through its open upper end.

The design of the icemaker mounting adapter 32 enables the icemaker 30 to conveniently be mounted on top of the ice and beverage dispenser 10, while providing enhanced sealing and sanitation of, and improved access to, the interior of the dispenser ice bin 16. The adapter has a gasket carrying frame 40 and a sanitary lid 34 carried at forward ends of a pair of integrated slider assemblies 36 by hinges 38, which lid normally covers the bin inlet 26. To open the bin inlet, for example to observe the quantity of ice in the bin or to manually introduce ice into the bin, the slider mechanisms allow the lid to be slid forward away from the ice making machine and dispenser and off of the inlet 26 to uncover the inlet, with the hinges then accommodating upward and rearward rotation of the lid about the forward ends of the slider mechanisms to fully expose and provide convenient access to the bin inlet. Because of the hinges the lid always remains attached to the adapter assembly, so it is not at risk of being lost or contaminated, as can happen with conventional adapter assemblies having removable lids. To subsequently close the bin inlet 26, the lid 34 can simply be rotated downward and then slid or pushed rearward to its position over and closing the inlet. The adaptor has a low profile that enables a front door of the icemaker to be opened while the icemaker remains on the adapter, so that the interior of the icemaker can be accessed without need to remove the adapter lid or dismount the icemaker from the adapter. Advantageously the adapter is provided as a kit so that ice/beverage dispensers in the field may be retrofit with an icemaker.

Before considering the specific structure of the icemaker mounting adapter 32, the manner in which its lid 34 accommodates convenient access to the interior of the ice bin 16 will first be considered. As shown in FIG. 2, with the adapter mounting the icemaker 30 on the dispenser 10, the adapter lid 34 is normally positioned over and closes the bin inlet 26. To uncover the bin inlet to gain access to the bin interior, as seen in FIG. 3 the lid is first manually pulled or slid forward on the pair of slider assemblies 36, each of which is a mirror image of the other. When the lid is in its forward position uncovering the bin inlet 26, as shown in FIG. 4 it is next rotated upward and rearward about the hinges 38, which hinges mount the lid to forward ends of the slider assemblies and each of which is a mirror image of the other, to move the lid fully away from and provide unimpeded access to the bin inlet, thereby to accommodate unimpeded access to the inlet to provide for convenient manual filling of the bin with ice. When fully rotated upward and rearward, the lid is inclined rearward and rests against the icemaker 30, so that it does not accidentally come down and injure an operator. For further operator safety, it is contemplated that suitable latch means (not shown) be provided to securely hold the lid in position when rotated upward. To subsequently close the bin inlet, the lid is simply rotated downward and forward and then pushed or slid rearward to its position over and closing the inlet.

With reference to FIGS. 5-9, the adapter assembly 32 includes the generally rectangular sheet metal frame 40 having U-channel shaped opposite sides 41*a-b* and back 41*c* for rigidity, and a front 41*d* that may be planar. In use, the bottom side of the adapter frame 40 rests on the top perimeter edge 28 of the dispenser ice bin 16, such that a rear of the bin perimeter edge and rearward portions of the sides of the bin perimeter edge are received in the openings in the U-channel shaped adapter back 41*c* and sides 41*a-b*, with the generally planar adapter front 41*d* extending between forward ends of the adapter sides 41*a-b* and defining to the front of it, and between it and the front bin perimeter edge, the bin inlet 26. The top side of the adapter then supports the icemaker 30 on the ice/beverage dispenser 10. Gasket material 42 is provided in a rectangular array on and along each of the upper and lower surfaces of the frame 40, thereby to provide a seal between the frame and the ice bin and between the frame and the icemaker. The frame 40 has a central opening 44, whereby ice manufactured by and exiting a lower end of the icemaker 30 falls through the adapter central opening into the ice bin 16.

The slider assemblies 36, at the forward ends of which the lid 34 is carried by the hinges 38, are identically configured and mirror images of each other. Each slider assembly comprises a slide arm 46 in which is formed a longitudinally extending channel 48 that is closed at opposite ends. The channel of each slide arm receives an associated pair of rollers 50, each of which pair of rollers is carried on an inner side of an associated one of the front to back parallel extending side walls 52 of the frame 40, to mount the slide arms for sliding movement along the side walls in forward and rearward directions. Each slide arm 46 is provided with an opening or passage 54 toward its forward end that is part of the hinge attachment of the lid 34 to the forward ends of the slide arms.

The lid 34 has an upper surface or wall 56 in which is formed a recessed area 58 for being gripped by an operator. The lid has walls extending downward from the upper wall, which include a front wall 60, opposite side walls 62 and a rear wall 64. The side walls 62 extend rearward beyond the rear wall 64 and each defines at its rearward end an associated hinge plate 66. Each hinge plate 66 carries an inward extending pin 68 that is received in the passage 54 at the forward end of an associated one of the slide arms 46 to mount the lid 34 on and to pivotally connect the lid to forward ends of the slide arms. Alternatively, an outward extending pin could be provided at the forward end of each slide arm in place of the passage 54, with each hinge plate 66 then having a passage in place of the pin 68, such that the pins on the slide arms would extend into the passages in the hinge plates to pivotally connect the lid to the hinge arms. In use of the adapter 32 a water drain channel 70 receives and directs condensate from the icemaker away from and toward the outside of the ice bin 16.

Figure 5:
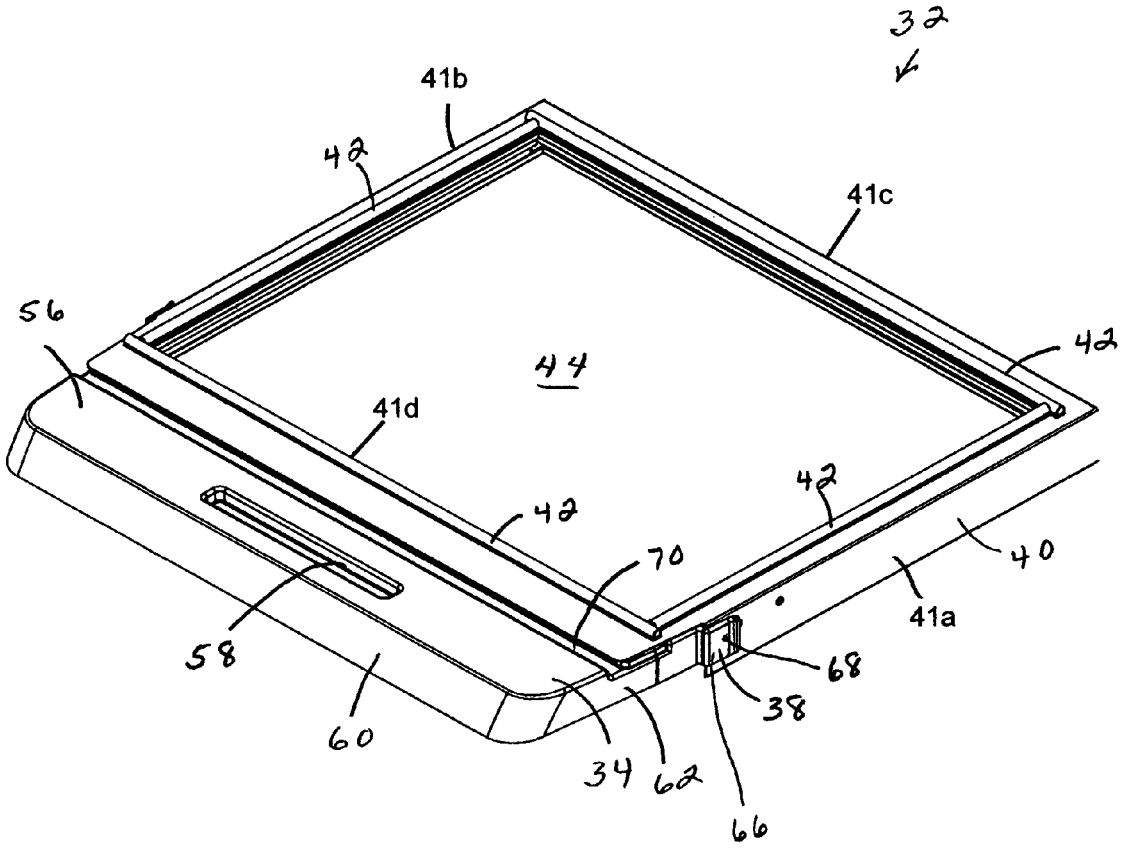
FIG. 5 is a perspective view of the icemaker adapter with its lid slid to its rearward position.
Figure 6:
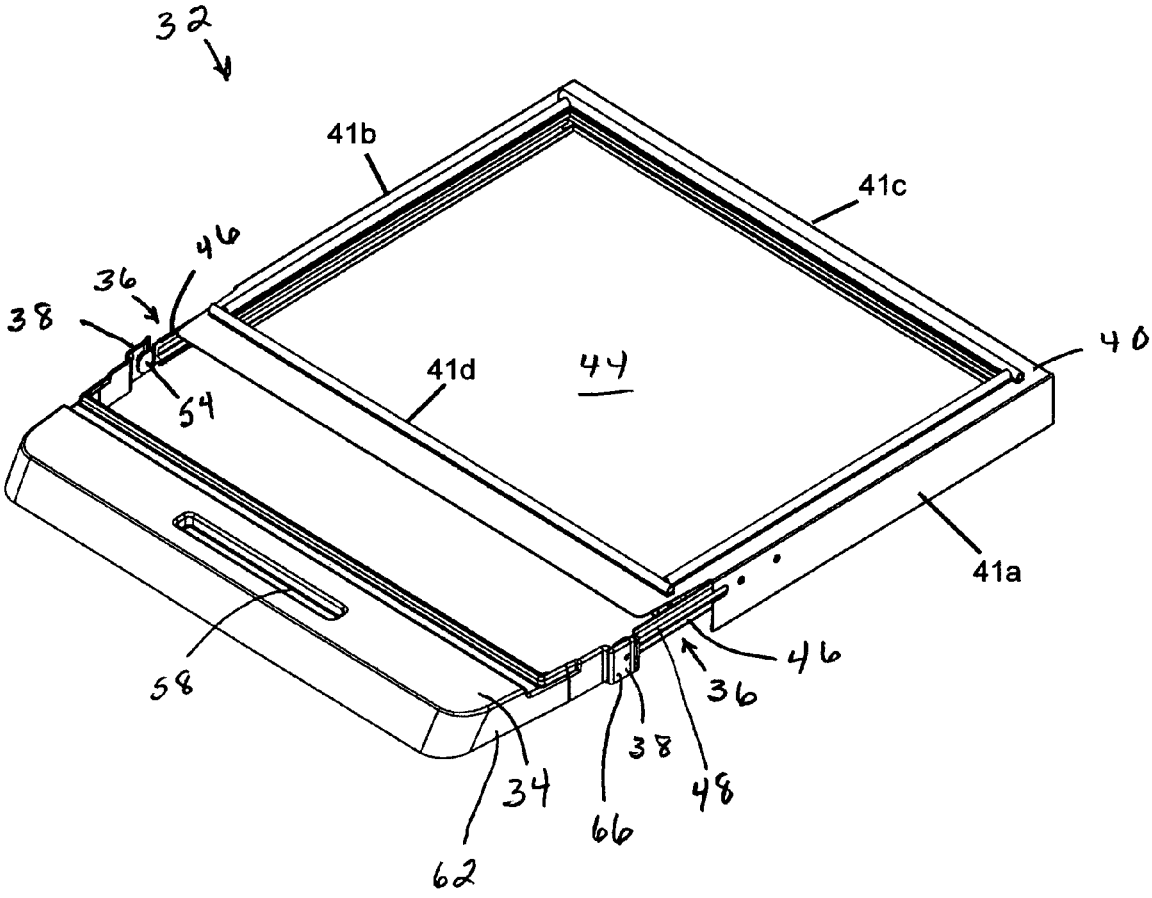
FIG. 6 is a perspective view of the ice maker adapter with its lid slid to its forward position.
Figure 7:
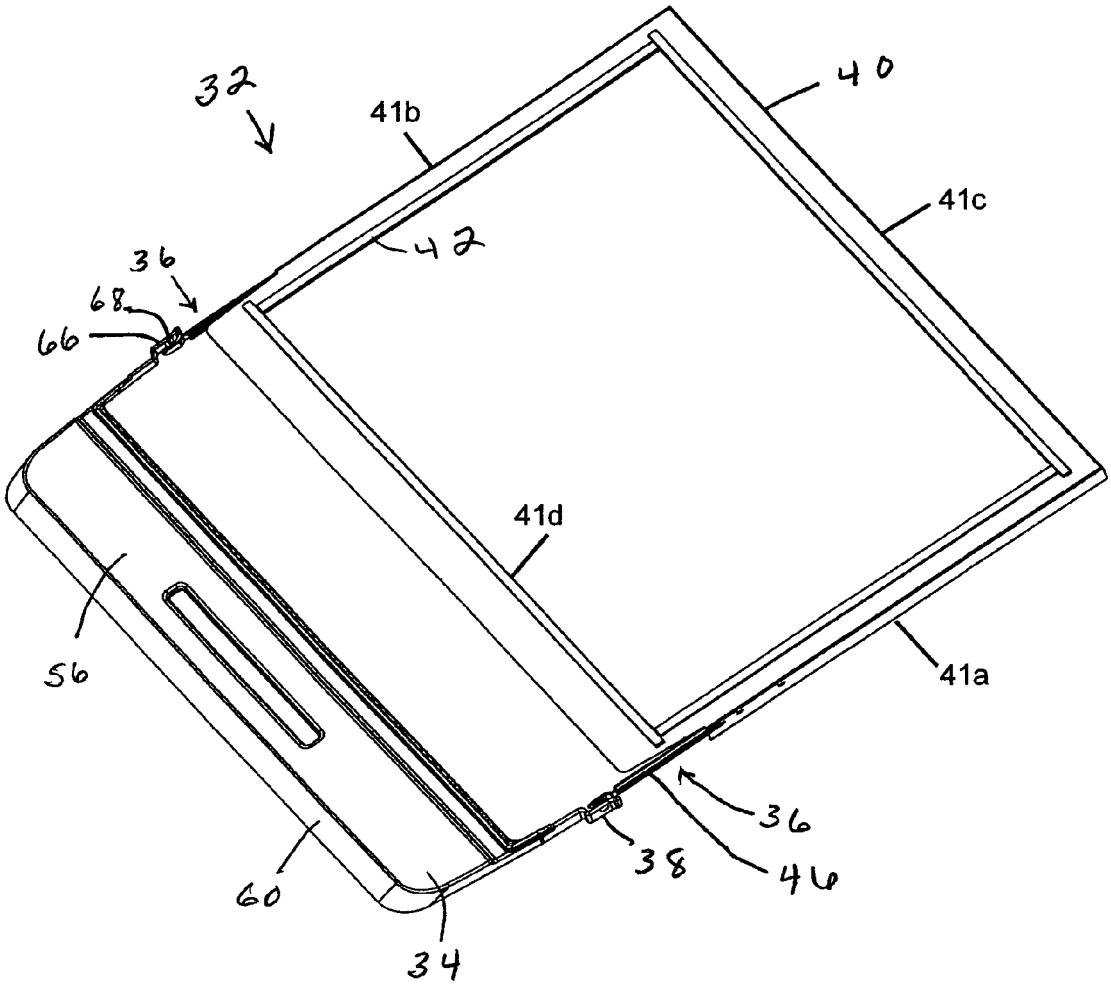
FIG. 7 is a perspective view of the ice maker adapter with its lid slid to its forward position, better showing the manner in which the lid is hinged to slide mechanisms of the adapter.
Figure 8:
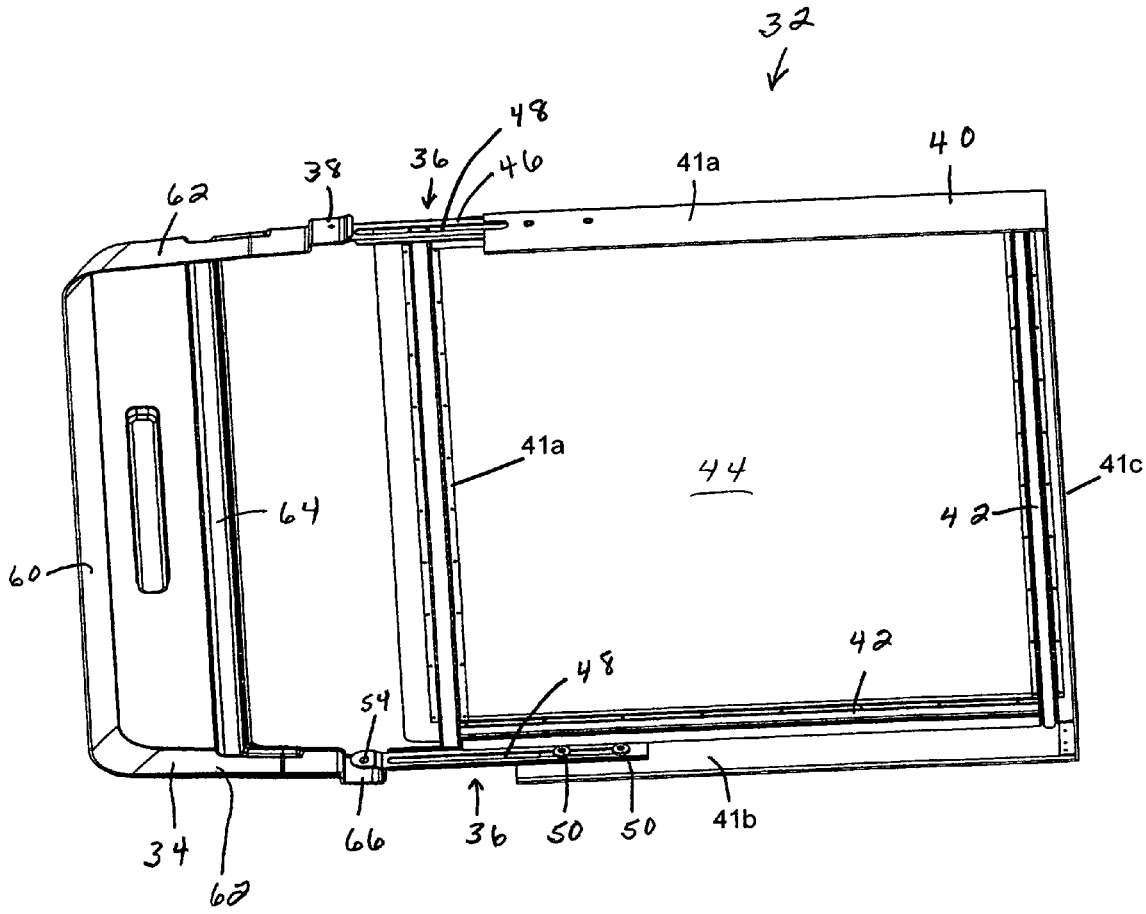
FIG. 8 is a bottom perspective view of the adapter.
Figure 9:
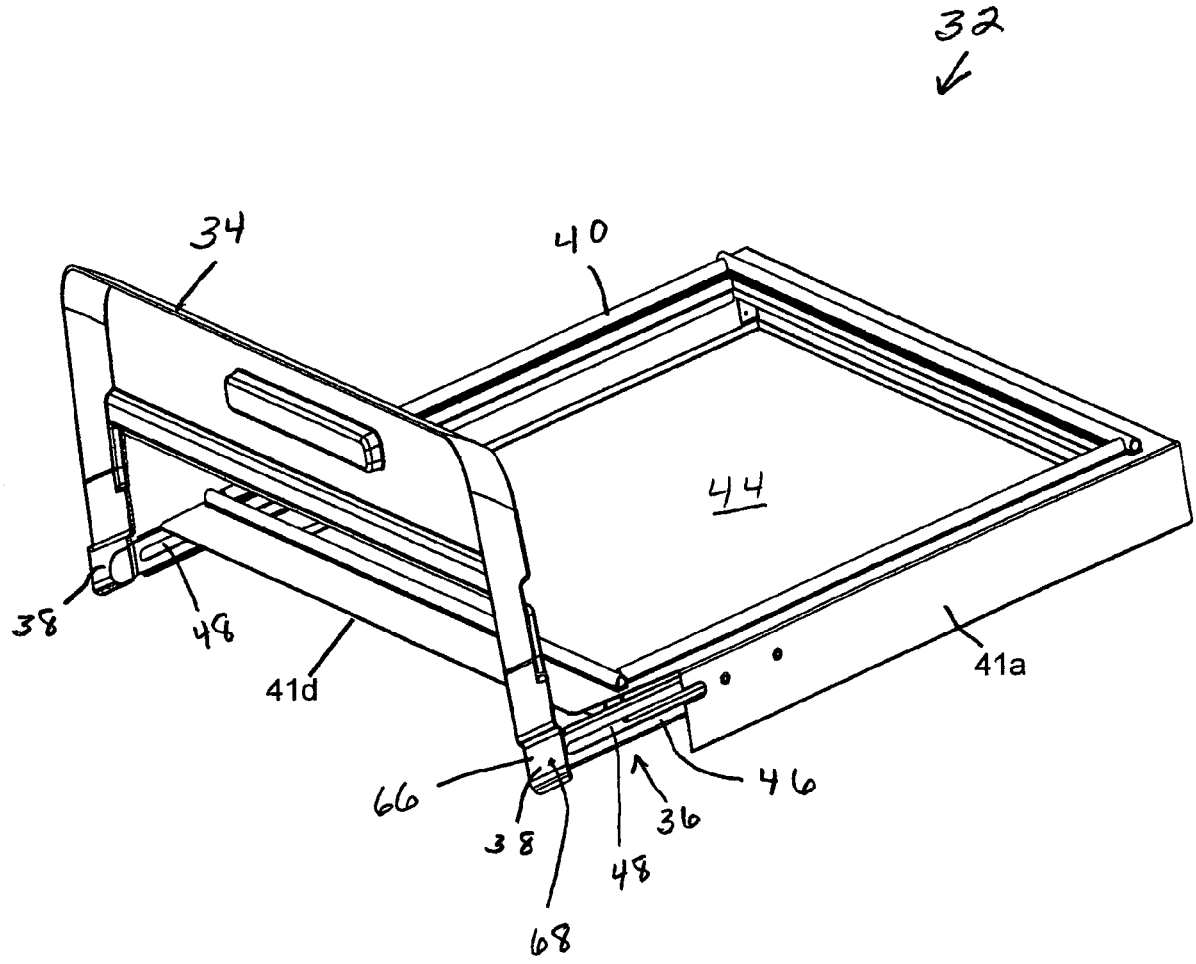
FIG. 9 is a perspective view of the adapter, showing its lid both slid forward and rotated upward.

FIG. 5 shows the adapter assembly 32 with the lid 34 in its rearward position closing the bin inlet 26 (also see FIG. 2); FIGS. 6-8 show the adapter assembly with the lid slid forward by movement of the slide arms 46 on the rollers 50, but not yet having been rotated upward and rearward (also see FIG. 3); and FIG. 9 shows the adapter assembly with the lid rotated upward and rearward on the hinges 38 and relative to forward ends of the slide arms 46 (also se FIG. 4), in which position of the lid the bin inlet 26 is fully exposed to accommodate visual inspection of the bin and/or manual filling of the bin with ice.

It is understood that while the invention has been described in terms of the adapter lid 34 being rotated upward after being slid forward, the invention contemplates that after the lid is slid forward it can be rotated downward, so that it then extends downward in front of the dispenser merchandising cover 14, in which position it also would provide unimpeded access to the bin inlet 26.

While embodiments of the invention has been described in detail, various modifications and other embodiments thereof may be devised by one skilled in the art without departing from the spirit and scope of the invention, as defined in the appended claims.

What is claimed is:

1. A beverage dispensing system, comprising:

an icemaker;

an ice and beverage dispenser having an ice retaining bin with an open upper end within a top perimeter edge of the bin; and an adapter mourning said icemaker on top of said dispenser, said adapter including:

a frame having an opening therethrough, a bottom side for being supported on a rearward portion of said bin top perimeter edge, and a top side for supporting said icemaker above said bin for passage of ice from said icemaker through said frame opening and into said bin, a front of said frame being spaced rearward from a front of said bin top perimeter edge and defining therebetween a forward inlet to said bin;

a lid normally extending over and closing, said bin inlet;

at least two slider assemblies;

means for slidably attaching said at least two slider assemblies to said frame for movement of said slider assemblies in forward and rearward directions relative to said frame; and at least two hinges positioned on forward ends of said slider assemblies and attaching said lid, to said forward ends of said slider assemblies for pivotal movement of said lid about an axis extending generally perpendicular to the directions of movement of said slider assemblies, said lid being moveable forward on said slider assemblies to uncover said bin inlet and then being rotatable on said hinges to a location away from said inlet.

2. A beverage dispensing system as in claim 1, wherein said frame is generally rectangular and has parallel and opposite sides and a back that are U-channel shaped and a front that extends between forward ends of said sides, said rearward portion of said bin top perimeter edge extending into open ends of said frame sides and back to support said frame on said bin.

3. A beverage dispensing system as in claim 2, wherein said at least two slider assemblies are two slider assemblies each slidably carried by an associated one of said frame sides for forward, and rearward movement relative to said frame sides.

4. A beverage dispensing, system as in claim 1, including gasket means on top and bottom sides of said frame to sealing said frame to each of said icemaker and said dispenser bin.

5. A beverage dispensing system as in claim 1, wherein said adapter, when said lid is closing said bin inlet, has a substantially planar upper side accommodating opening of a door on a front of said icemaker while said icemaker is supported on said adapter.

6. A beverage dispensing system, comprising:

an icemaker, an ice and beverage dispenser having an ice retaining bin with an open upper end within a top perimeter edge of the bin; and an adapter mounting said icemaker on top of said dispenser, said adapter including:

a frame having an opening therethrough, a bottom side for being, supported on a rearward portion of said bin top perimeter edge, and a top side for supporting said icemaker above said bin for passage of ice from said icemaker through said frame opening and into said bin, a front of said frame being spaced rearward from a front of said bin top perimeter edge and defining therebetween a forward inlet to said bin;

a lid normally extending over and closing said bin inlet, wherein said lid includes channel means for receiving and directing water from said icemaker away from an interior of said bin;

at least two slider assemblies;

means for slidably attaching said at least two slider assemblies to said frame for movement of said slider assemblies in forward and rearward directions relative to said frame; and at least two hinges positioned on forward ends of said slider assemblies and attaching said lid to said forward ends of said slider assemblies for pivotal movement of said lid about an axis extending generally perpendicular to the directions of movement of said slider assemblies, said lid being moveable forward on said slider assemblies to uncover said bin inlet and then being rotatable on said hinges to a location away from said inlet.

7. A beverage dispensing system as in claim 6, wherein said frame is generally rectangular and has parallel and opposite sides and a back that are U-channel shaped and a front that extends between forward ends of said sides, said rearward portion of said bin top perimeter edge extending into open ends of said frame sides and back to support said frame on said bin.

8. A beverage dispensing system as in claim 7, wherein said at least two slider assemblies are two slider assemblies each slidably carried by an associated one of said frame sides for forward and rearward movement relative to said frame sides.

9. A beverage dispensing system as in claim 6, including gasket means on top and bottom sides of said frame for sealing said frame to each of said icemaker and said dispenser bin.

10. A beverage dispensing system as in claim 6, wherein said adapter, when said lid is closing said bin inlet, has a substantially planar upper side accommodating opening of a door on a front of said icemaker while said icemaker is supported on said adapter.

11. A beverage dispensing system, comprising:

icemaker;

an ice and beverage dispenser having an ice retaining bin with an open upper end within a top perimeter edge of the bin; and an adapter mounting said icemaker on top of said dispenser, said adapter including:

a frame having an opening therethrough, a bottom side for being supported on a rearward portion of said bin top perimeter edge, and a top side for supporting said icemaker above said bin for passage of ice from said icemaker through said frame opening and into said bin, a front of said frame being spaced rearward from a front of said bin top perimeter edge and defining therebetween a forward inlet to said bin;

a lid normally extending over and closing said bin inlet;

at least two slider assemblies;

means for slidably attaching said at least two slider assemblies to said frame for movement of said slider assemblies in forward and rearward directions relative to said frame, wherein said at least two slider assemblies comprise slide arms having longitudinally extending channels receiving rollers carried on inner sides of side walls of the frame mounting the slide arms for sliding movement along the side walls in forward and rearward directions; and at least two hinges positioned on forward ends of said slider assemblies and attaching said lid to said forward ends of said slider assemblies for pivotal movement of said lid about an axis extending generally perpendicular to the directions of movement of said slider assemblies, said lid being moveable forward on said slider assemblies to uncover said bin inlet and then being rotatable on said hinges to a location away from said inlet.

12. A beverage dispensing system as in claim 11, wherein said frame is generally rectangular and has parallel and opposite sides and a back that are U-channel shaped and a front that extends between forward ends of said sides, said rearward portion of said bin top perimeter edge extending into open ends of said frame sides and back to support said frame on said bin.

13. A beverage dispensing system as in claim 11, including gasket means on top and bottom sides of said frame for sealing said frame to each of said icemaker and said dispenser bin.

14. A beverage dispensing system as in claim 11, wherein said lid includes channel means for receiving and directing water from said icemaker away from an interior of said bin.

15. A beverage dispensing system as in claim 11, wherein said adapter, when said lid is closing said bin inlet, has a substantially planar upper side accommodating opening of a door on a front of said icemaker while said icemaker is supported on said adapter.

* * * * *